US011648647B2

(12) United States Patent
Chu et al.

(10) Patent No.: US 11,648,647 B2
(45) Date of Patent: May 16, 2023

(54) PNEUMATIC CLAMPING DEVICE

(71) Applicant: PRIMAX ELECTRONICS LTD., Taipei (TW)

(72) Inventors: Chien-Chang Chu, Taipei (TW); Yi-Hou Chen, Taipei (TW)

(73) Assignee: PRIMAX ELECTRONCS LTD., Taipei (TW)

( * ) Notice: Subject to any disclaimer, the term of this patent is extended or adjusted under 35 U.S.C. 154(b) by 131 days.

(21) Appl. No.: 17/482,486

(22) Filed: Sep. 23, 2021

(65) Prior Publication Data

US 2023/0042676 A1 Feb. 9, 2023

(30) Foreign Application Priority Data

Aug. 9, 2021 (TW) ..... 110129264

(51) Int. Cl.
*B25B 5/00* (2006.01)
*B25B 5/06* (2006.01)

(52) U.S. Cl.
CPC ..... *B25B 5/061* (2013.01)

(58) Field of Classification Search
CPC .... B25B 5/00; B25B 5/02; B25B 5/04; B25B 5/061; B25B 5/12
See application file for complete search history.

(56) References Cited

U.S. PATENT DOCUMENTS 6,663,093 B2 * 12/2003 Yonezawa ..... B25B 5/062 269/27
6,666,489 B2 * 12/2003 Kruger ..... B25B 5/087 294/197
6,748,841 B1 * 6/2004 Fritz ..... B25J 15/0206 269/20
8,474,806 B2 * 7/2013 Orgeron ..... B25B 5/147 269/45
8,496,238 B1 * 7/2013 Orgeron ..... E21B 19/155 29/244
2002/0093211 A1 * 7/2002 Filipiak ..... B25B 5/087 294/203
2003/0151266 A1 * 8/2003 Moilanen ..... B25J 15/0226 294/203
2004/0004366 A1 * 1/2004 Moilanen ..... B25B 5/087 294/203
2004/0130083 A1 * 7/2004 Moilanen ..... B25B 5/087 269/32
2008/0237957 A1 * 10/2008 Waldorf ..... B25J 15/0206 269/27

(Continued)

*Primary Examiner* — Lee D Wilson
(74) *Attorney, Agent, or Firm* — WPAT, P.C.

(57) ABSTRACT

A pneumatic clamping device includes a main body, a piston, a first linkage member and a second linkage member. The main body includes a chamber. The piston includes a pillar part. The first linkage member includes a first arm part and a second arm part. The second linkage member includes a third arm part and a fourth arm part. When the air is introduced into the chamber, the pillar part is gradually moved to push the first arm part and the third arm part, so that the second arm part is externally expanded relative to the fourth arm part. When the air is exited from the chamber, the pillar part is gradually moved to pull back the first arm part and the third arm part, so that the second arm part is internally retracted relative to the fourth arm part.

12 Claims, 11 Drawing Sheets

(56) References Cited

U.S. PATENT DOCUMENTS

| | | | | |
|---|---|---|---|---|
| 2010/0187740 | A1* | 7/2010 | Orgeron | E21B 19/155 269/218 |
| 2016/0136789 | A1* | 5/2016 | Fukui | B25B 5/064 269/152 |
| 2023/0042676 | A1* | 2/2023 | Chu | B25B 5/04 |

* cited by examiner

PNEUMATIC CLAMPING DEVICE

FIELD OF THE INVENTION

The present invention relates to a clamping device, and more particularly to a pneumatic clamping device.

BACKGROUND OF THE INVENTION

In many processes or production line instructions, vacuum suction nozzles and mechanical claws are often used at the same time to perform the clamping tasks. For example, a robotic claw is disclosed in Chinese Patent No. CN209551756. However, the structure of this robotic claw is complicated. In addition, the precise control and cooperation between the vacuum nozzle and the robotic claw is required to successfully complete the clamping task. In other words, the conventional technology needs to be further improved.

SUMMARY OF THE INVENTION

The present invention provides a pneumatic clamping device. When the pneumatic clamping device is connected with the gas transportation pipeline for the original suction nozzle, the pneumatic clamping device is able to perform the clamping task smoothly. That is, the structure of the pneumatic clamping device is simple. In addition, it is not necessary to the largely change the instructions in the original process or production line.

In accordance with an aspect of the present invention, a pneumatic clamping device is provided. The pneumatic clamping device includes a main body, a piston, a first linkage member and a second linkage member. The main body includes a first opening, a second opening, a chamber, a first pivotal part and a second pivotal part. The chamber is arranged between the first opening and the second opening. In addition, air is selectively introduced into the chamber or exited from the chamber through the first opening. The piston includes a head part and a pillar part. The head part is disposed within the chamber. The pillar part is connected with the head part and penetrated through the second opening. The first linkage member includes a first arm part, a second arm part and a first fulcrum part. The first arm part is installed on the pillar part. The first fulcrum part is installed on the first pivotal part. The first fulcrum part is connected with the first arm part and the second arm part. The second linkage member includes a third arm part, a fourth arm part and a second fulcrum part. The third arm part is installed on the pillar part. The second fulcrum part is installed on the second pivotal part. The second fulcrum part is connected with the third arm part and the fourth arm part. When the air is introduced into the chamber, the pillar part is gradually moved to push the first arm part and the third arm part, so that the second arm part is externally expanded relative to the fourth arm part. When the air is exited from the chamber, the pillar part is gradually moved to pull back the first arm part and the third arm part, so that the second arm part is internally retracted relative to the fourth arm part.

In an embodiment, the pneumatic clamping device is connected with an inflation/deflation device. When the inflation/deflation device performs a deflation operation, the air is exited from the chamber. When the inflation/deflation device performs an inflation operation, the air is introduced into the chamber.

In an embodiment, the pneumatic clamping device further includes a connector. The connector is coupled with the first opening, and the connector is connected with a gas transportation pipeline.

In an embodiment, the pneumatic clamping device further includes a first claw and a second claw. The first claw is connected with the second arm part. The second claw is connected with the fourth arm part.

In an embodiment, the main body further includes a sealing cover. The sealing cover is a part of the chamber. The second opening is formed in the sealing cover.

In accordance with another aspect of the present invention, a pneumatic clamping device is provided. The pneumatic clamping device includes a main body, a piston and a first linkage member. The main body includes a first opening, a second opening, a chamber and a first pivotal part. The chamber is arranged between the first opening and the second opening. In addition, air is selectively introduced into the chamber or exit from the chamber through the first opening. The piston includes a head part and a pillar part. The head part is disposed within the chamber. The pillar part is connected with the head part and penetrated through the second opening. The first linkage member includes a first arm part, a second arm part and a first fulcrum part. The first arm part is installed on the pillar part. The first fulcrum part is installed on the first pivotal part. The first fulcrum part is connected with the first arm part and the second arm part. When the air is introduced into the chamber, the pillar part is gradually moved to push the first arm part, and the second arm part is rotated relative to the first fulcrum part. When the air is exited from the chamber, the pillar part is gradually moved to pull back the first arm part, and the second arm part is reversely rotated relative to the first fulcrum part.

In an embodiment, the main body further includes a second pivotal part. The first pivotal part and the second pivotal part are located at two opposite sides of the main body, respectively.

In an embodiment, the pneumatic clamping device further includes a second linkage member, and the second linkage member includes a third arm part, a fourth arm part and a second fulcrum part. The third arm part is installed on the pillar part. The second fulcrum part is installed on the second pivotal part. The second fulcrum part is connected with the third arm part and the fourth arm part. When the air is introduced into the chamber, the pillar part is gradually moved to push the third arm part, and the fourth arm part is rotated relative to the second fulcrum part. When the air is exited from the chamber, the pillar part is gradually moved to pull back the third arm part, and the fourth arm part is reversely rotated relative to the second fulcrum part.

In an embodiment, the pneumatic clamping device is connected with an inflation/deflation device. When the inflation/deflation device performs a deflation operation, the air is exited from the chamber. When the inflation/deflation device performs an inflation operation, the air is introduced into the chamber.

In an embodiment, the pneumatic clamping device further includes a connector. The connector is coupled with the first opening, and the connector is connected with a gas transportation pipeline.

In an embodiment, the pneumatic clamping device further includes a first claw and a second claw. The first claw is connected with the second arm part. The second claw is connected with the fourth arm part.

In an embodiment, the main body further includes a sealing cover. The sealing cover is a part of the chamber. The second opening is formed in the sealing cover.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. In the following embodiments and drawings, the elements irrelevant to the concepts of the present invention are omitted and not shown.

Figure 1:
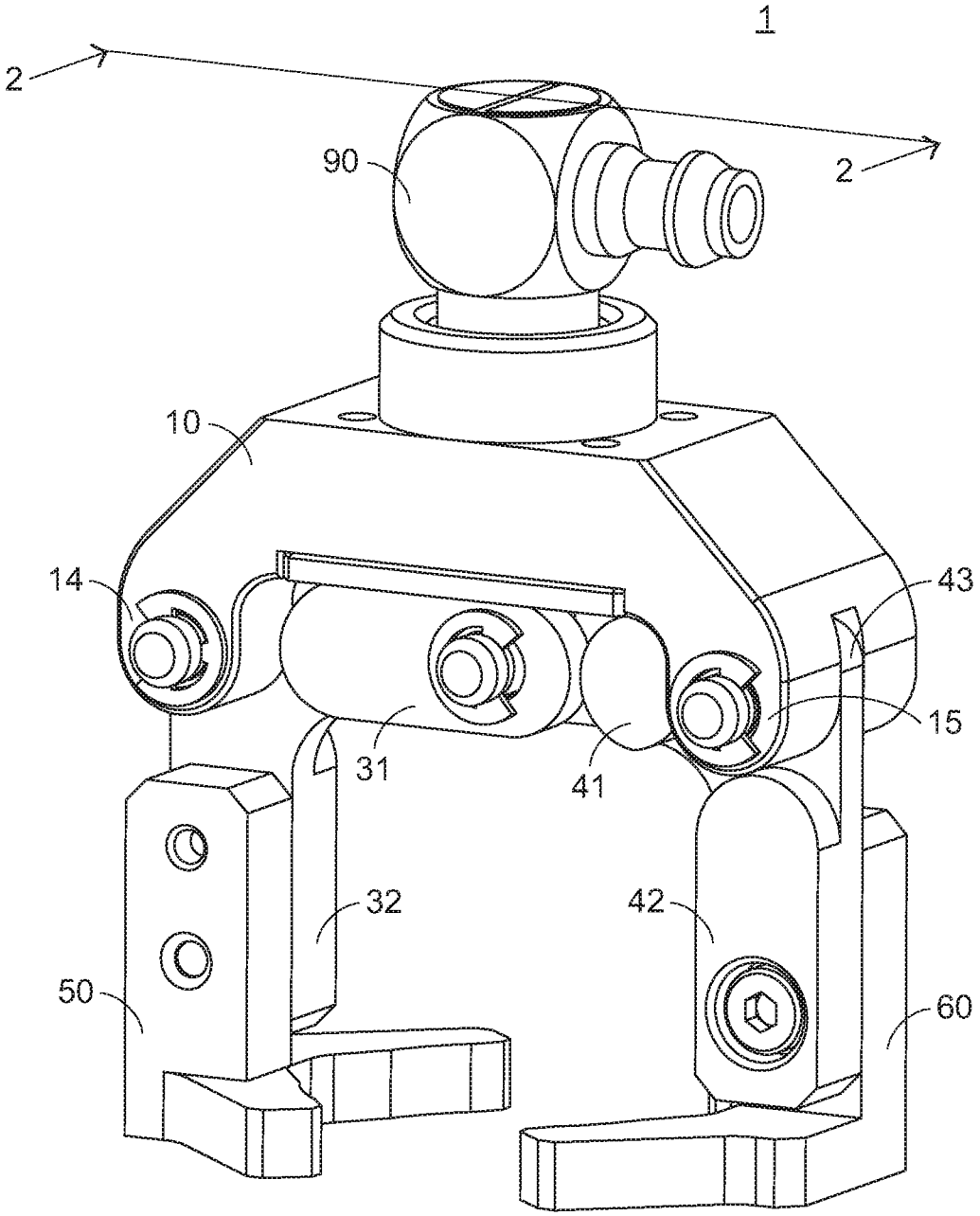
FIG. 1 is a schematic perspective view illustrating a pneumatic clamping device according to an embodiment of the present invention.
Figure 2:
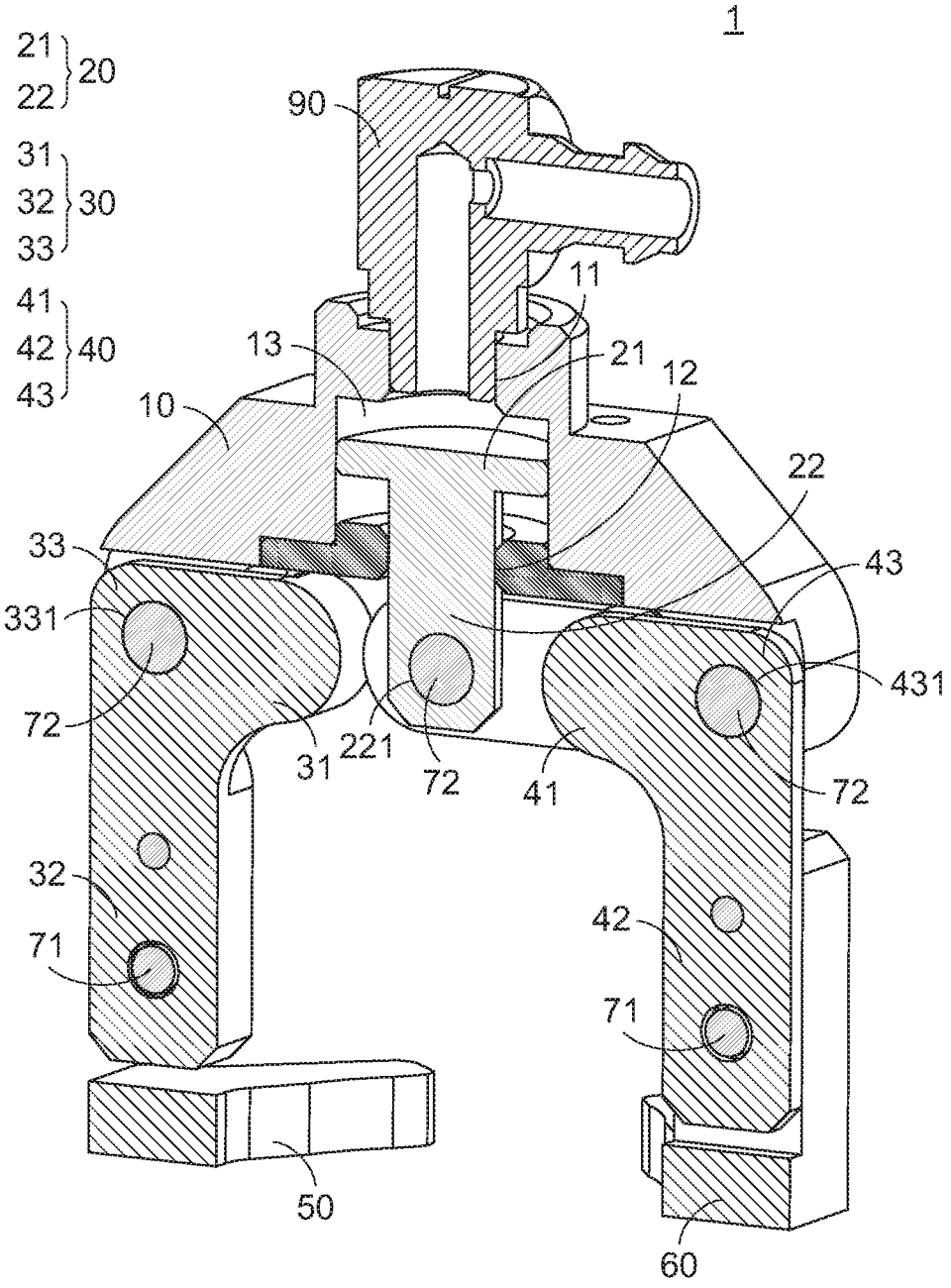
FIG. 2 is a schematic cutaway view illustrating the pneumatic clamping device as shown in FIG. 1 and taken along the line 2-2.
Figure 3:
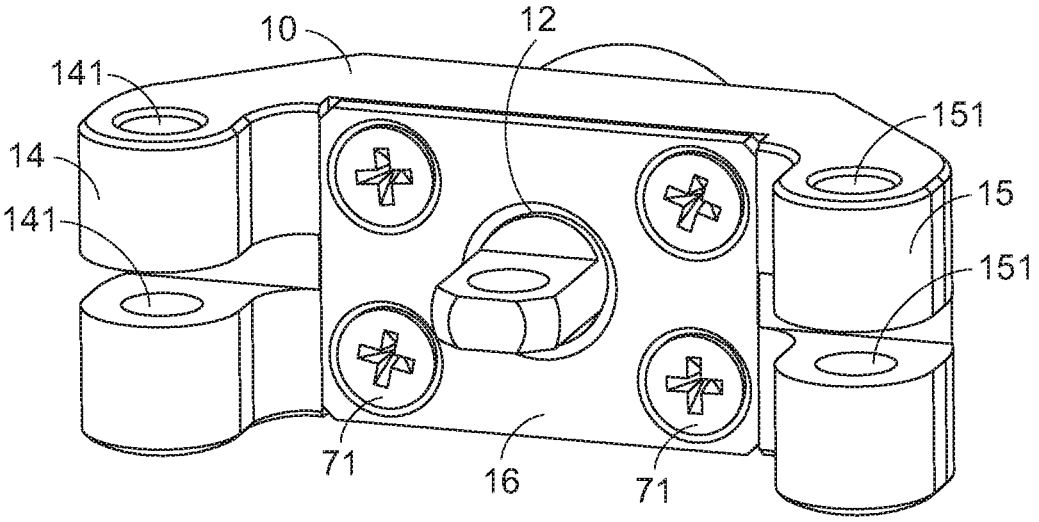
FIG. 3 is a schematic perspective view illustrating the assembled structure of the main body and the piston of the pneumatic clamping device according to the embodiment of the present invention.
Figure 4:
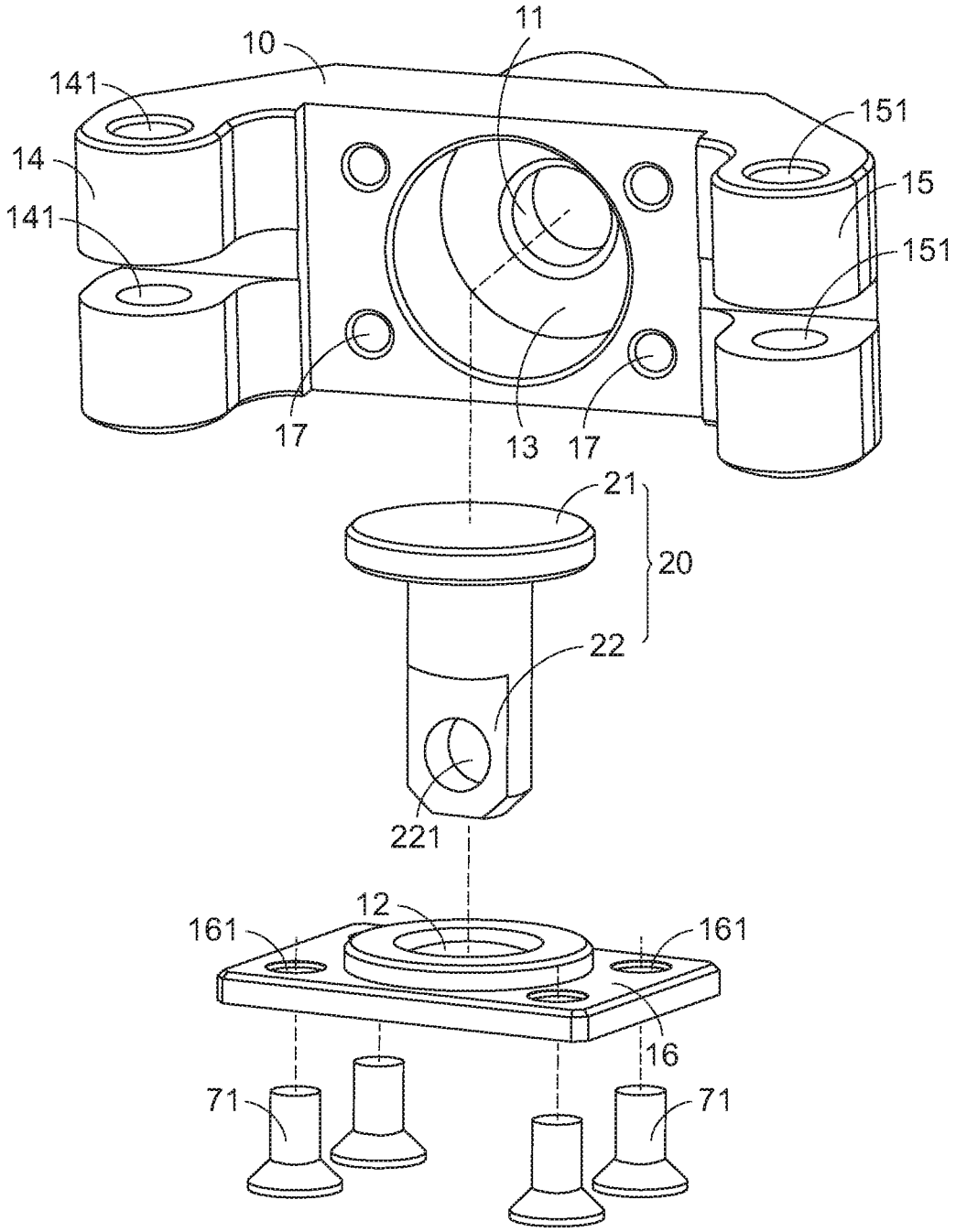
FIG. 4 is a schematic exploded view illustrating the relationship between the main body and the piston of the pneumatic clamping device according to the embodiment of the present invention.
Figure 5:
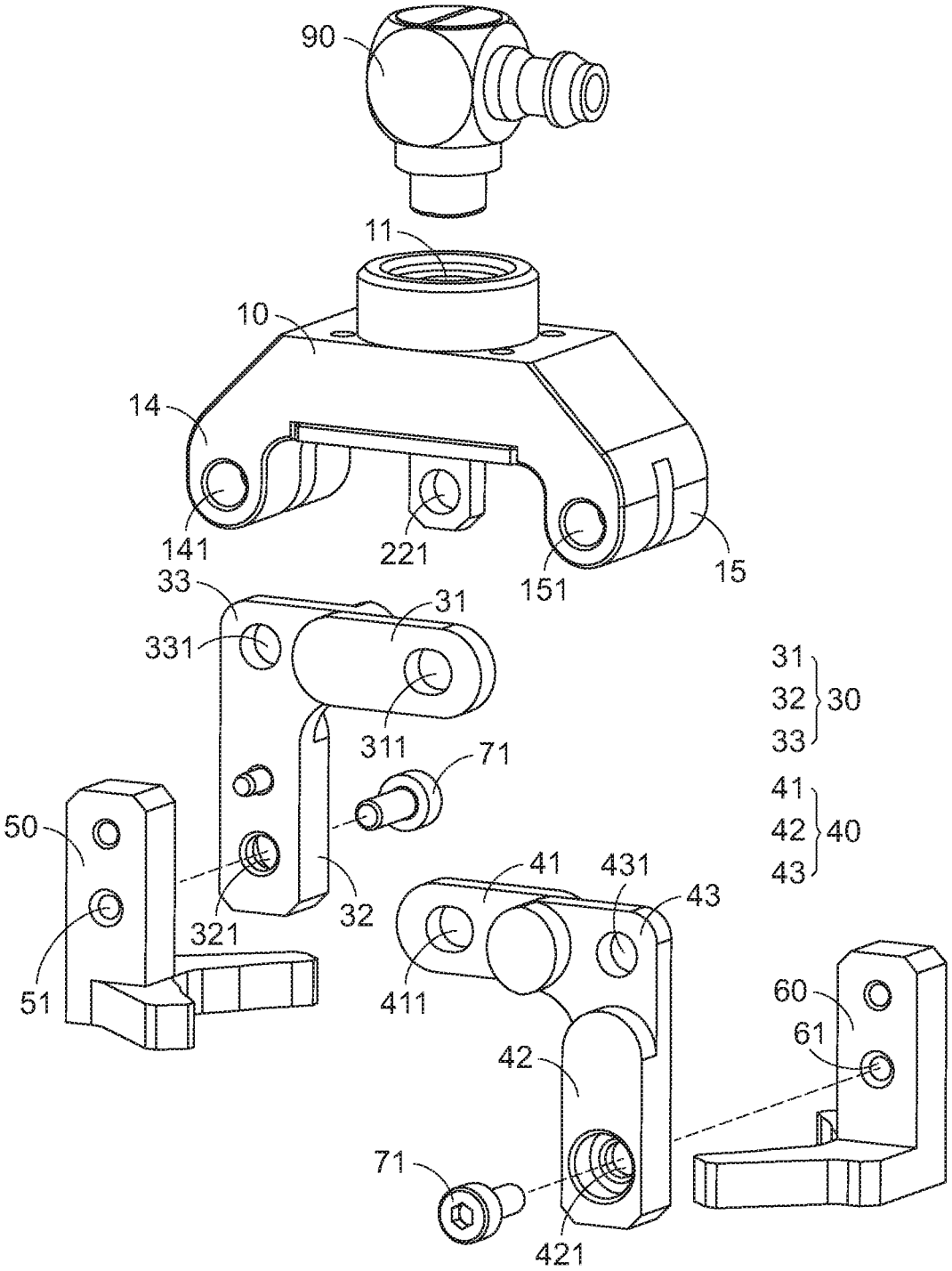
FIG. 5 is a schematic exploded view illustrating the relationships between the linkage members and the corresponding claws of the pneumatic clamping device according to the embodiment of the present invention.
Figure 6:
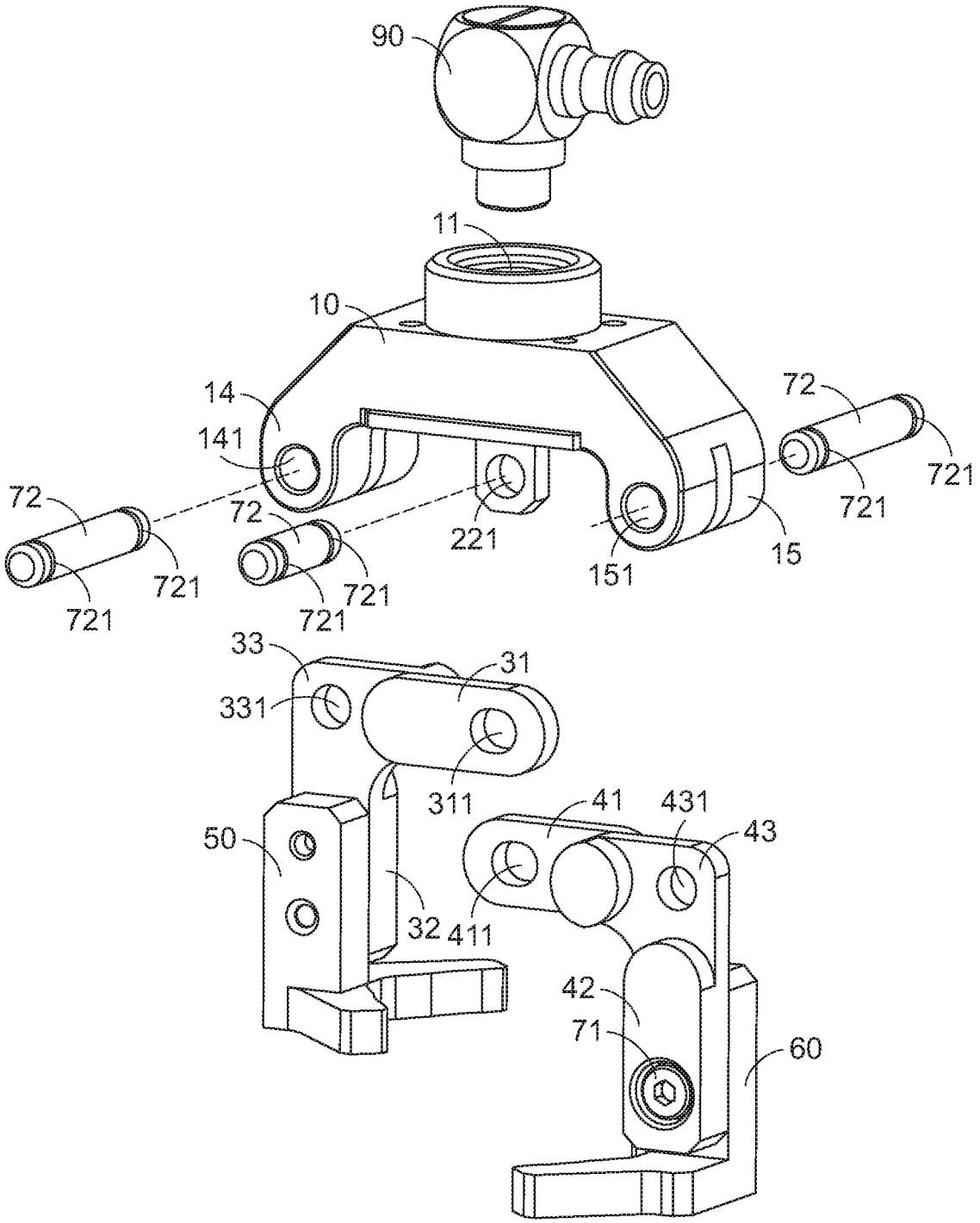
FIG. 6 is a schematic perspective view illustrating the assembled structure of the linkage members and the corresponding claws of the pneumatic clamping device according to the embodiment of the present invention.
Figure 7:
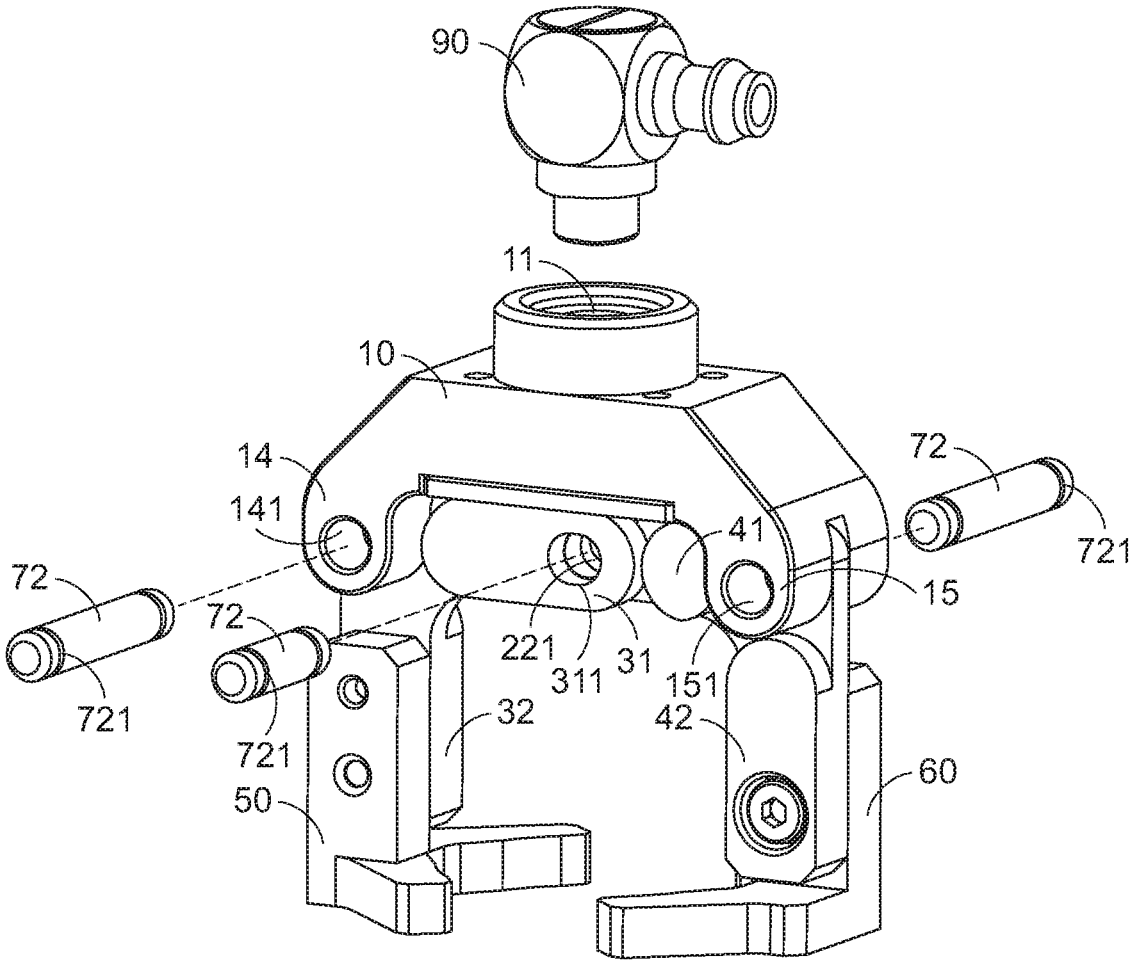
FIG. 7 is a schematic perspective view illustrating the relationship between the linkage members and the main body of the pneumatic clamping device before the assembling process.
Figure 8:
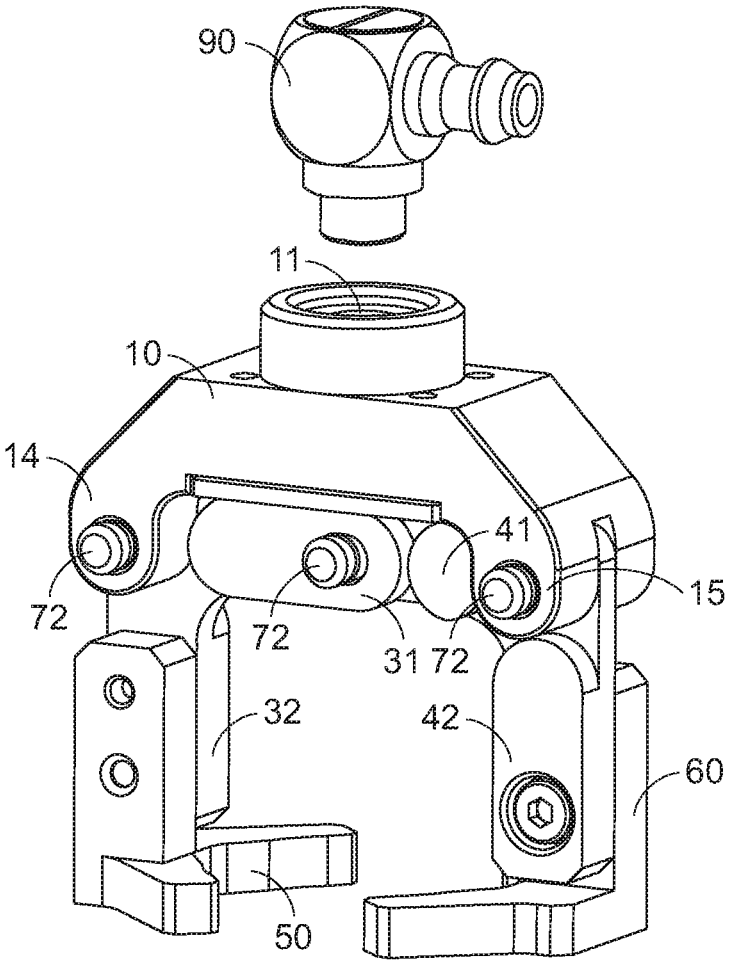
FIG. 8 is a schematic perspective view illustrating the relationship between the linkage members and the main body of the pneumatic clamping device during the assembling process.
Figure 9:
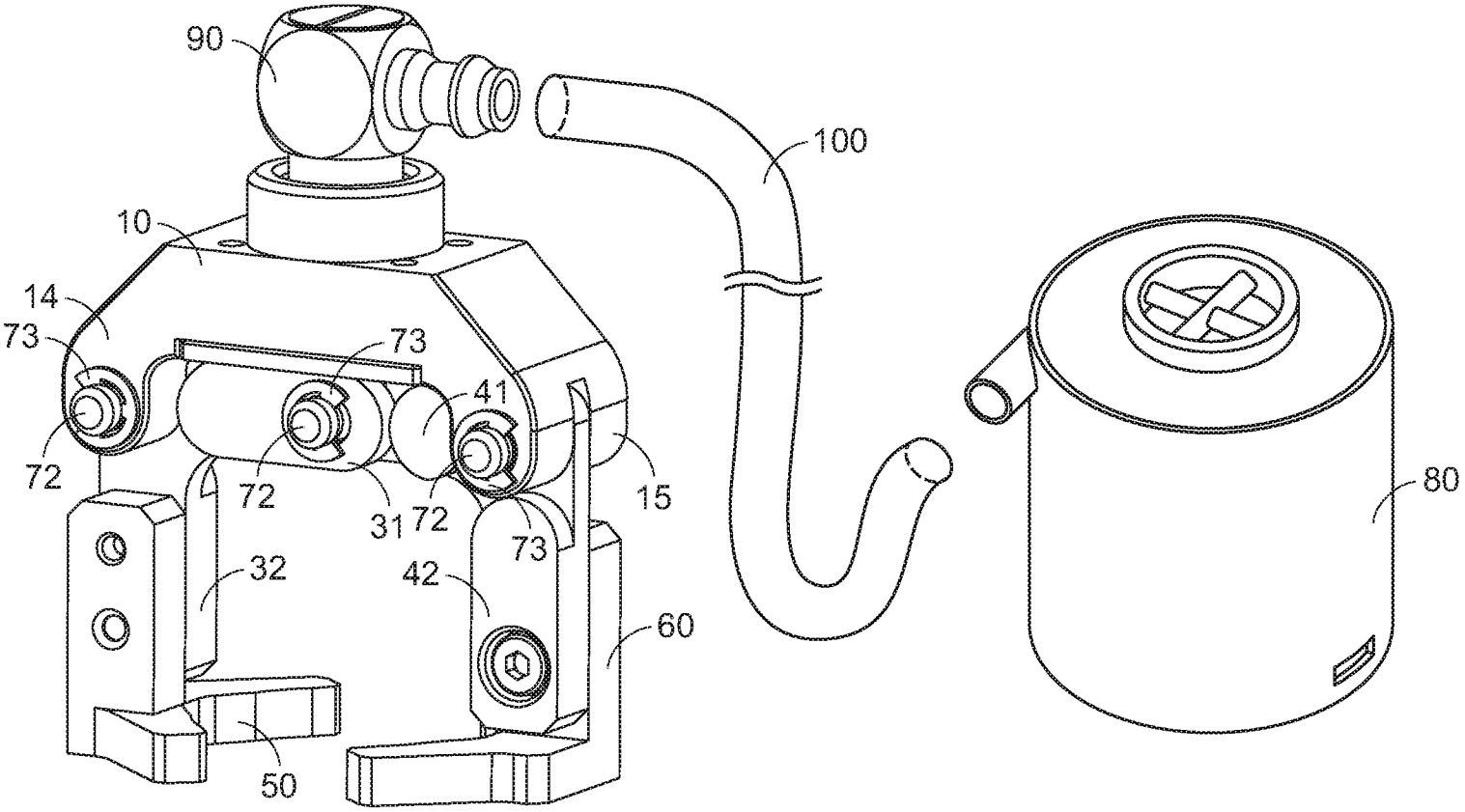
FIG. 9 is a schematic perspective view illustrating the relationship between the linkage members and the main body of the pneumatic clamping device after the assembling process.

FIG. 1 is a schematic perspective view illustrating a pneumatic clamping device according to an embodiment of the present invention. FIG. 2 is a schematic cutaway view illustrating the pneumatic clamping device as shown in FIG. 1 and taken along the line 2-2. FIG. 3 is a schematic perspective view illustrating the assembled structure of the main body and the piston of the pneumatic clamping device according to the embodiment of the present invention. FIG. 4 is a schematic exploded view illustrating the relationship between the main body and the piston of the pneumatic clamping device according to the embodiment of the present invention. FIG. 5 is a schematic exploded view illustrating the relationships between the linkage members and the corresponding claws of the pneumatic clamping device according to the embodiment of the present invention. FIG. 6 is a schematic perspective view illustrating the assembled structure of the linkage members and the corresponding claws of the pneumatic clamping device according to the embodiment of the present invention. FIG. 7 is a schematic perspective view illustrating the relationship between the linkage members and the main body of the pneumatic clamping device before the assembling process. FIG. 8 is a schematic perspective view illustrating the relationship between the linkage members and the main body of the pneumatic clamping device during the assembling process. FIG. 9 is a schematic perspective view illustrating the relationship between the linkage members and the main body of the pneumatic clamping device after the assembling process.

The present invention provides a pneumatic clamping device. An example of the pneumatic clamping device 1 will be illustrated with reference to FIGS. 1 to 9. The pneumatic clamping device 1 comprises a main body 10, a piston 20, a first linkage member 30, a second linkage member 40, a first claw 50 and a second claw 60.

The main body 10 comprises a first opening 11, a second opening 12, a chamber 13, a first pivotal part 14, a second pivotal part 15 and a sealing cover 16. The chamber 13 is arranged between the first opening 11 and the second opening 12. The air can be introduced into the chamber 13 or exited from the chamber 13 through the first opening 11. The first pivotal part 14 and the second pivotal 15 are located at two opposite sides of the main body 10, respectively.

The piston 20 comprises a head part 21 and a pillar part 22. The head part 21 is disposed within the chamber 13. The pillar part 22 is connected with the head part 21 and penetrated through the second opening 12.

Please refer to FIGS. 2, 3 and 4. The sealing cover 16 is a part of the chamber 13. In addition, the second opening 12 is formed in the sealing cover 16. After the piston 20 is placed into the chamber 13 as shown in FIGS. 2 and 3, the head part 21 of the piston 20 is sealed in the chamber 13 by the sealing cover 16. Consequently, the head part 21 of the piston 20 is only permitted to be moved within the chamber 13. However, the pillar part 22 of the piston 20 is exposed outside through the second opening 12. In addition, plural tapped holes 17 are formed in the main body 10. Moreover, plural countersunk holes 161 (or pivotal holes) are correspondingly formed in the sealing cover 16. Consequently, after plural screws 71 are penetrated through the corresponding countersunk holes 161 and tightened into the corresponding tapped holes 17, the sealing cover 16 is fixed on the main body 10.

The first linkage member 30 comprises a first arm part 31, a second arm part 32 and a first fulcrum part 33. The first fulcrum part 33 is served as the fulcrum of the first leakage member 30. The first fulcrum part 33 is connected with the first arm part 31 and the second arm part 32. After the first linkage member 30 is assembled with the main body 10, the first arm part 31 is installed on the pillar part 22, and the first fulcrum part 33 is installed on the first pivotal part 14.

The second linkage member 40 comprises a third arm part 41, a fourth arm part 42 and a second fulcrum part 43. The second fulcrum part 43 is served as the fulcrum of the second leakage member 40. The second fulcrum part 43 is connected with the third arm part 41 and the fourth arm part 42. After the second linkage member 40 is assembled with the main body 10, the third arm part 41 is installed on the pillar part 22, and the second fulcrum part 43 is installed on the second pivotal part 15.

In the pneumatic clamping device 1 of this embodiment, the first claw 50 and the second claw 60 can be used to clamp objects with different shapes or sizes. The first claw 50 is connected with the second arm part 32 of the first leakage member 30. The second claw 60 is connected with the fourth arm part 42 of the second leakage member 40. Please refer to FIGS. 5 and 6. In this embodiment, a tapped hole 51 is formed in the first claw 50, and a countersunk hole 321 (or a pivotal hole) is formed in the second arm part 32. After a screw 71 is penetrated through the countersunk hole 321 and tightened into the tapped hole 51, the first claw 50 is fixed on the second arm part 32. Similarly, a tapped hole 61 is formed in the second claw 60, and a countersunk hole 421 (or a pivotal hole) is formed in the fourth arm part 42. After a screw 71 is penetrated through the countersunk hole 421 and tightened into the tapped hole 61, the second claw 60 is fixed on the fourth arm part 42. It is noted that the method of connecting the first claw 50 with the second arm part 32 and the method of connecting the second claw 60 with the fourth arm leg 42 are not restricted. For example, the detachable connecting method or the non-detachable connecting method are feasible.

Please refer to FIGS. 3 to 9 again. In the pneumatic clamping device 1, a pivotal hole 141 is formed in the first pivotal part 14 of the main body 10, and a pivotal hole 331 is formed in the first fulcrum part 33 of the first leakage member 30. In the pneumatic clamping device 1, a first shaft 72 is penetrated through the pivotal holes 141 and 331. Consequently, the first fulcrum part 33 is installed on the first pivotal part 14, and the first fulcrum part 33 and the first pivotal part 14 are rotatable relative to each other. A groove 721 is formed in the first shaft 72. After the first shaft 72 is penetrated through the pivotal holes 141 and 331, an E-shaped ring 73 is locked in the groove 721. Consequently, the first shaft 72 is not detached from the pivotal holes 141 and 331. Similarly, a pivotal hole 151 is formed in the second pivotal part 15 of the main body 10, and a pivotal hole 431 is formed in the second fulcrum part 43 of the second leakage member 40. In the pneumatic clamping device 1, a second shaft 72 is penetrated through the pivotal holes 151 and 431. Consequently, the second fulcrum part 43 is installed on the second pivotal part 15, and the second fulcrum part 43 and the second pivotal part 15 are rotatable relative to each other. A groove 721 is formed in the second shaft 72. After the second shaft 72 is penetrated through the pivotal holes 151 and 431, an E-shaped ring 73 is locked in the groove 721. Consequently, the second shaft 72 is not detached from the pivotal holes 151 and 431.

Please refer to FIGS. 3 to 9 again. In the pneumatic clamping device 1, a pivotal hole 221 is formed in the pillar part 22 of the piston 20. A pivotal hole 331 is formed in the first arm part 31 of the first leakage member 30, and a pivotal hole 411 is formed in the third arm part 41 of the second leakage member 40. In the pneumatic clamping device 1, a third shaft 72 is penetrated through the pivotal holes 331, 221 and 411. Consequently, the first arm part 31 and the third arm part 41 are installed on the pillar part 22. In addition, the first arm part 31 and the pillar part 22 are rotatable relative to each other, and the third arm 41 and the pillar part 22 are rotatable relative to each other. A groove 721 is formed in the third shaft 72. After the third shaft 72 is penetrated through the pivotal holes 331, 221 and 411, an E-shaped ring 73 is locked in the groove 721. Consequently, the third shaft 72 is not detached from the pivotal holes 311, 221 and 411.

In the pneumatic clamping device 1, the first opening 11 is in communication with the surroundings. For example, the first opening 11 is connected with an inflation/deflation device 80. The inflation/deflation device 80 can selectively perform an inflation operation or a deflation operation. When the deflation operation is performed, the air is exited from the chamber 13 through the first opening 11. When the inflation operation is performed, the air is introduced into the chamber 13 through the first opening 11. In order to be connected with the inflation/deflation device 80, the pneumatic clamping device 1 further comprises a connector 90. The connector 90 is coupled with the first opening 11. After the connector 90 is connected with a gas transportation pipeline 100, the gas transportation pipeline 100 is connected with the inflation/deflation device 80 through the connector 90. Moreover, the gas transportation pipeline 100 uses the pipeline for the suction nozzle in the original process or production line. Consequently, when the pneumatic clamping device 1 is connected with the gas transportation pipeline for the original suction nozzle, the pneumatic clamping device 1 is able to perform the clamping task smoothly.

Figure 10:
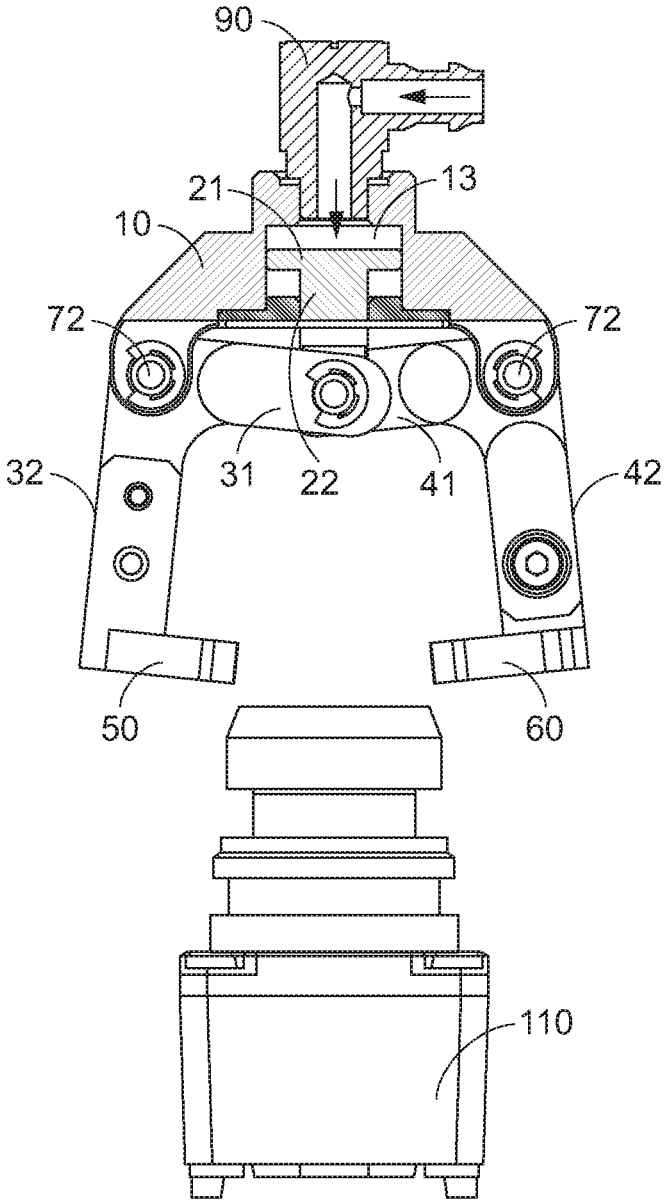
FIG. 10 is a schematic perspective view illustrating the condition before or after the object is clamped by the pneumatic clamping device.

FIG. 10 is a schematic perspective view illustrating the condition before or after the object is clamped by the pneumatic clamping device. Please refer to FIG. 10. After the air is introduced into the chamber 13, the pillar part 22 is gradually moved to externally push the first arm part 31 and the third arm part 41. During this process, the second arm part 32 is rotated relative to the first fulcrum part 33 (i.e., the rotation center), and the fourth arm part 42 is rotated relative to the second fulcrum part 43 (i.e., the rotation center). Afterwards, the second arm part 32 is externally expanded relative to the fourth arm part 42, or the fourth arm part 42 is externally expanded relative to the second arm part 32. In this stage, the pneumatic clamping device 1 can be moved toward a to-be-clamped object 110, or the to-be-clamped object 110 can be moved toward the pneumatic clamping device 1.

Figure 11:
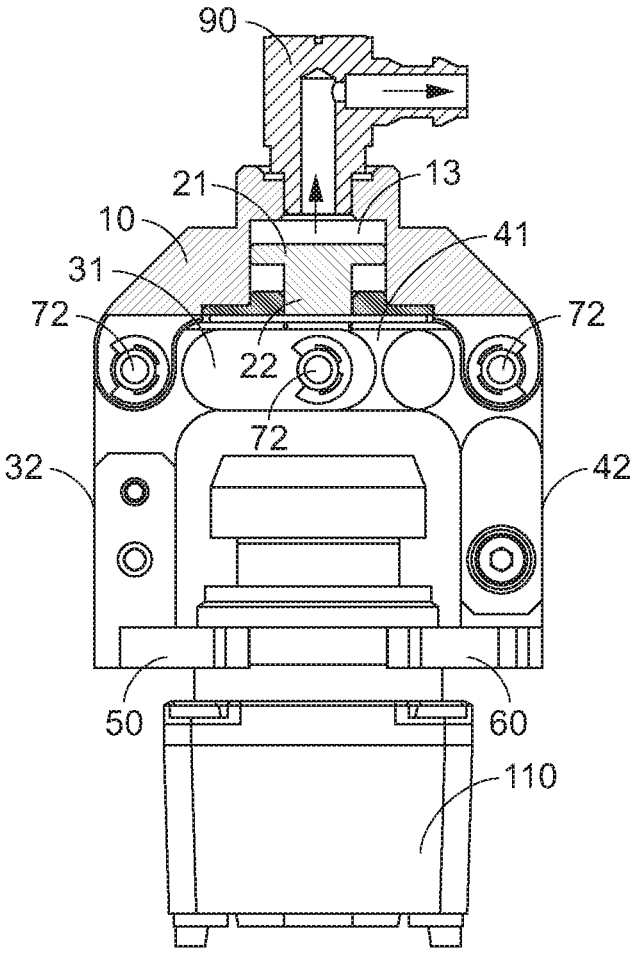
FIG. 11 is a schematic perspective view illustrating the condition when the object is clamped by the pneumatic clamping device.

FIG. 11 is a schematic perspective view illustrating the condition when the object is clamped by the pneumatic clamping device. Please refer to FIG. 11. When the pneumatic clamping device 1 and the to-be-clamped object 110 are placed at the proper positions, the deflation operation is performed and thus the air is gradually exited from the chamber 13. Meanwhile, the pillar part 22 is gradually moved to internally pull back the first arm part 31 and the third arm part 41, and the second arm part 32 and the fourth arm part 42 are reversely rotated relative to the first fulcrum part 33 and second fulcrum part 43 (i.e., the rotation centers), respectively. Afterwards, the second arm part 32 is internally retracted relative to the fourth arm part 42, or the fourth arm part 42 is internally retracted relative to the second arm part 32. In addition, the second arm part 32 and the fourth arm part 42 are moved toward the to-be-clamped object 110 to clamp the to-be-clamped object 110. As the pneumatic clamping device 1 is moved, the to-be-clamped object 110 is correspondingly moved to another place. After the to-be-clamped object 110 is moved to fixed position, the reversed operation is performed. That is, the deflation operation is stopped, or the inflation operation is started. Consequently, the air is introduced into the chamber 13. At the same time, the pillar part 22 is gradually moved to externally push the first arm part 31 and the third arm part 41. Consequently, the pneumatic clamping device 1 releases the to-be-clamped object 110.

From the above descriptions, the present invention provides the pneumatic clamping device 1. After the air is introduced into the chamber 13, the pillar part 22 is gradually moved to externally push the first arm part 31 and the third arm part 41. Consequently, the second arm part 32 is externally expanded relative to the fourth arm part 42, or the fourth arm part 42 is externally expanded relative to the second arm part 32. It is noted that numerous modifications and alterations may be made while retaining the teachings of the invention. For example, in another embodiment, the pillar part 22 is gradually moved to externally push the first arm part 31 or the third arm part 41 only. In this way, the purpose of externally expanding the second arm part 32 relative to the fourth arm part 42 or externally expanding the fourth arm part 42 relative to the second arm part 32 is also achievable.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A pneumatic clamping device, comprising:

a main body comprising a first opening, a second opening, a chamber, a first pivotal part and a second pivotal part, wherein the chamber is arranged between the first opening and the second opening, and air is selectively introduced into the chamber or exited from the chamber through the first opening;

a piston comprising a head part and a pillar part, wherein the head part is disposed within the chamber, and the pillar part is connected with the head part and penetrated through the second opening;

a first linkage member comprising a first arm part, a second arm part and a first fulcrum part, wherein the first arm part is installed on the pillar part, the first fulcrum part is installed on the first pivotal part, and the first fulcrum part is connected with the first arm part and the second arm part; and a second linkage member comprising a third arm part, a fourth arm part and a second fulcrum part, wherein the third arm part is installed on the pillar part, the second fulcrum part is installed on the second pivotal part, and the second fulcrum part is connected with the third arm part and the fourth arm part, wherein when the air is introduced into the chamber, the pillar part is gradually moved to push the first arm part and the third arm part, so that the second arm part is externally expanded relative to the fourth arm part, wherein when the air is exited from the chamber, the pillar part is gradually moved to pull back the first arm part and the third arm part, so that the second arm part is internally retracted relative to the fourth arm part.

2. The pneumatic clamping device according to claim 1, wherein the pneumatic clamping device is connected with an inflation/deflation device, wherein when the inflation/deflation device performs a deflation operation, the air is exited from the chamber, wherein when the inflation/deflation device performs an inflation operation, the air is introduced into the chamber.

3. The pneumatic clamping device according to claim 1, wherein the pneumatic clamping device further comprises a connector, wherein the connector is coupled with the first opening, and the connector is connected with a gas transportation pipeline.

4. The pneumatic clamping device according to claim 1, wherein the pneumatic clamping device further comprises a first claw and a second claw, wherein the first claw is connected with the second arm part, and the second claw is connected with the fourth arm part.

5. The pneumatic clamping device according to claim 1, wherein the main body further comprises a sealing cover, wherein the sealing cover is a part of the chamber, and the second opening is formed in the sealing cover.

6. A pneumatic clamping device, comprising:

a main body comprising a first opening, a second opening, a chamber and a first pivotal part, wherein the chamber is arranged between the first opening and the second opening, and air is selectively introduced into the chamber or exit from the chamber through the first opening;

a piston comprising a head part and a pillar part, wherein the head part is disposed within the chamber, and the pillar part is connected with the head part and penetrated through the second opening; and a first linkage member comprising a first arm part, a second arm part and a first fulcrum part, wherein the first arm part is installed on the pillar part, the first fulcrum part is installed on the first pivotal part, and the first fulcrum part is connected with the first arm part and the second arm part, wherein when the air is introduced into the chamber, the pillar part is gradually moved to push the first arm part, and the second arm part is rotated relative to the first fulcrum part, wherein when the air is exited from the chamber, the pillar part is gradually moved to pull back the first arm part, and the second arm part is reversely rotated relative to the first fulcrum part.

7. The pneumatic clamping device according to claim 6, wherein the main body further comprises a second pivotal part, wherein the first pivotal part and the second pivotal part are located at two opposite sides of the main body, respectively.

8. The pneumatic clamping device according to claim 6, wherein the pneumatic clamping device further comprises a second linkage member, and the second linkage member comprises a third arm part, a fourth arm part and a second fulcrum part, wherein the third arm part is installed on the pillar part, the second fulcrum part is installed on the second pivotal part, and the second fulcrum part is connected with the third arm part and the fourth arm part, wherein when the air is introduced into the chamber, the pillar part is gradually moved to push the third arm part, and the fourth arm part is rotated relative to the second fulcrum part, wherein when the air is exited from the chamber, the pillar part is gradually moved to pull back the third arm part, and the fourth arm part is reversely rotated relative to the second fulcrum part.

9. The pneumatic clamping device according to claim 6, wherein the pneumatic clamping device is connected with an inflation/deflation device, wherein when the inflation/deflation device performs a deflation operation, the air is exited from the chamber, wherein when the inflation/deflation device performs an inflation operation, the air is introduced into the chamber.

10. The pneumatic clamping device according to claim 6, wherein the pneumatic clamping device further comprises a connector, wherein the connector is coupled with the first opening, and the connector is connected with a gas transportation pipeline.

11. The pneumatic clamping device according to claim 8, wherein the pneumatic clamping device further comprises a first claw and a second claw, wherein the first claw is connected with the second arm part, and the second claw is connected with the fourth arm part.

12. The pneumatic clamping device according to claim 6, wherein the main body further comprises a sealing cover, wherein the sealing cover is a part of the chamber, and the second opening is formed in the sealing cover.

* * * * *